United States Patent [19]

Weber, Sr.

[11] 4,364,520

[45] Dec. 21, 1982

[54] PISTON PUMP ACTUATED DIAPHRAGM PUMP FOR SPRAYING LIQUIDS

[76] Inventor: Edwin J. Weber, Sr., 1903 Curie Dr., Severn, Md. 21144

[21] Appl. No.: 181,346

[22] Filed: Aug. 26, 1970

[51] Int. Cl.[3] ..... B05B 9/04

[52] U.S. Cl. ..... 239/330; 239/332

[58] Field of Search ..... 239/330, 332, 333, 351, 239/334, 355, 361, 367; 222/333, 382, 383, 211, 464

[56] References Cited

U.S. PATENT DOCUMENTS 3,993,250 11/1976 Shure ..... 239/332

4,162,037 7/1979 Koyama ..... 239/332

FOREIGN PATENT DOCUMENTS 2018789 4/1970 Fed. Rep. of Germany ..... 239/332

*Primary Examiner*—James B. Marbert

*Attorney, Agent, or Firm*—Brady, O'Boyle & Gates

[57] ABSTRACT

A motor actuated piston pump assembly is mounted in a housing which is detachably connected to a container closure having a diaphragm pump-spray nozzle assembly mounted thereon. The piston pump actuates the diaphragm pump-spray nozzle assembly for dispensing liquid from the container, the piston pump and diaphragm pump being constructed and arranged so that the piston pump does not become contaminated by the liquid being dispensed and thus can be detachably connected to other containers having similarly mounted diaphragm pump-spray nozzle assemblies for successively dispensing various types of liquids.

8 Claims, 9 Drawing Figures

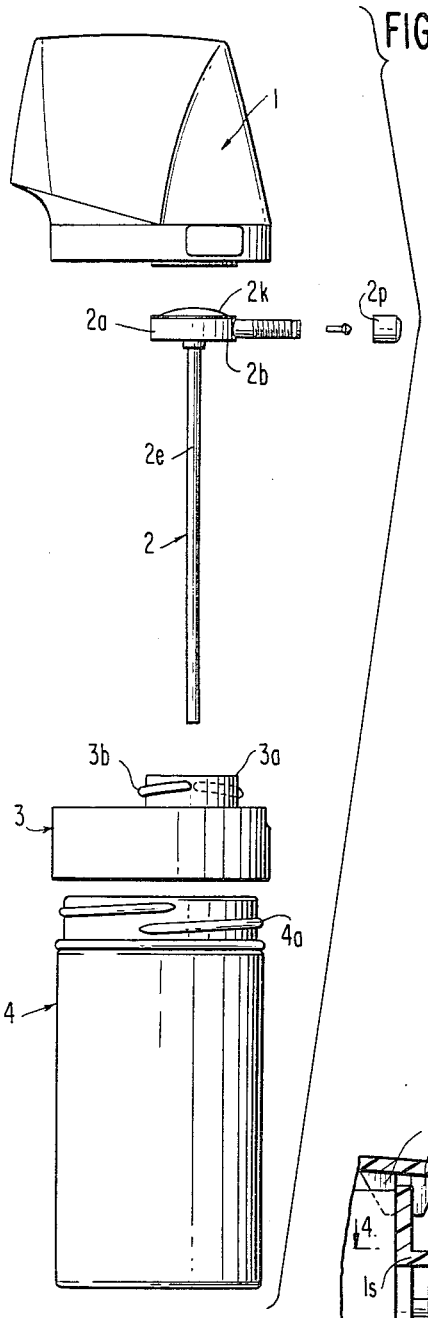
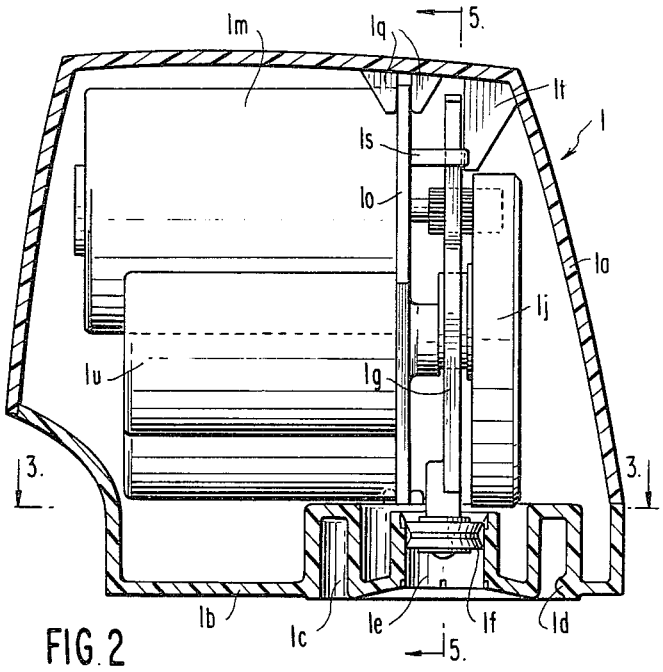
FIG.2
FIG.3
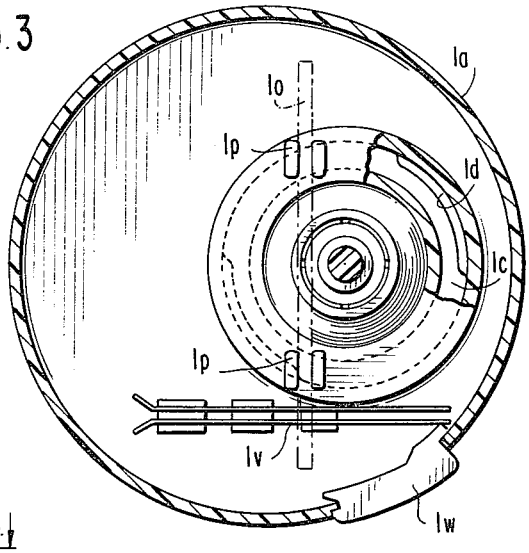
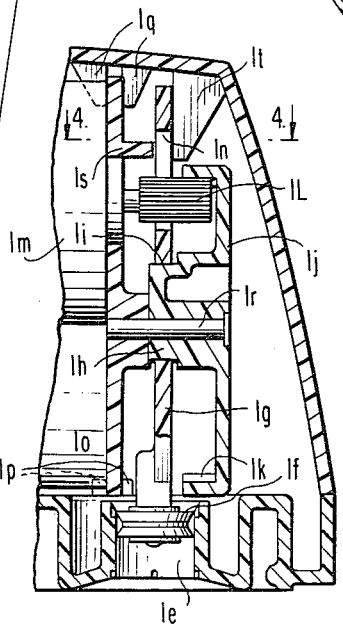
FIG.2A
FIG.4
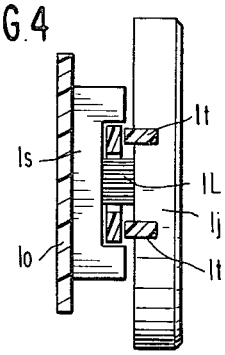

FIG. 5
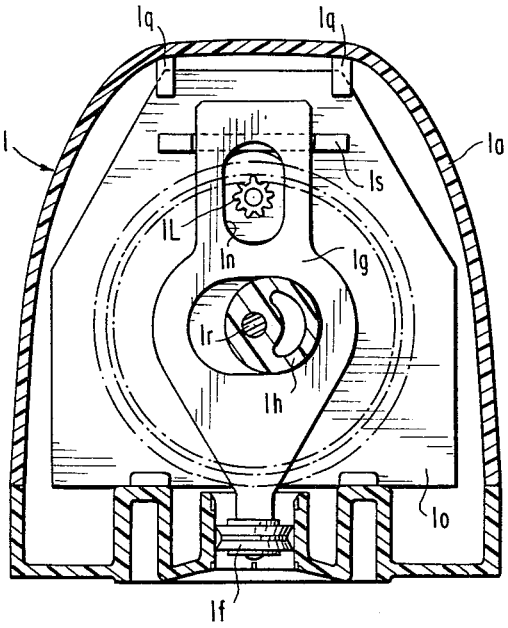
FIG. 6
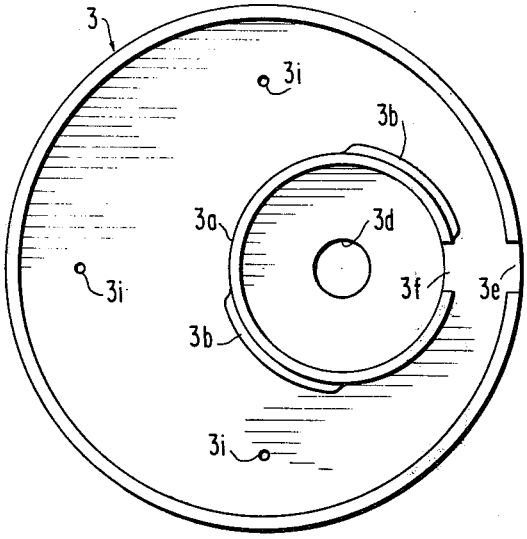
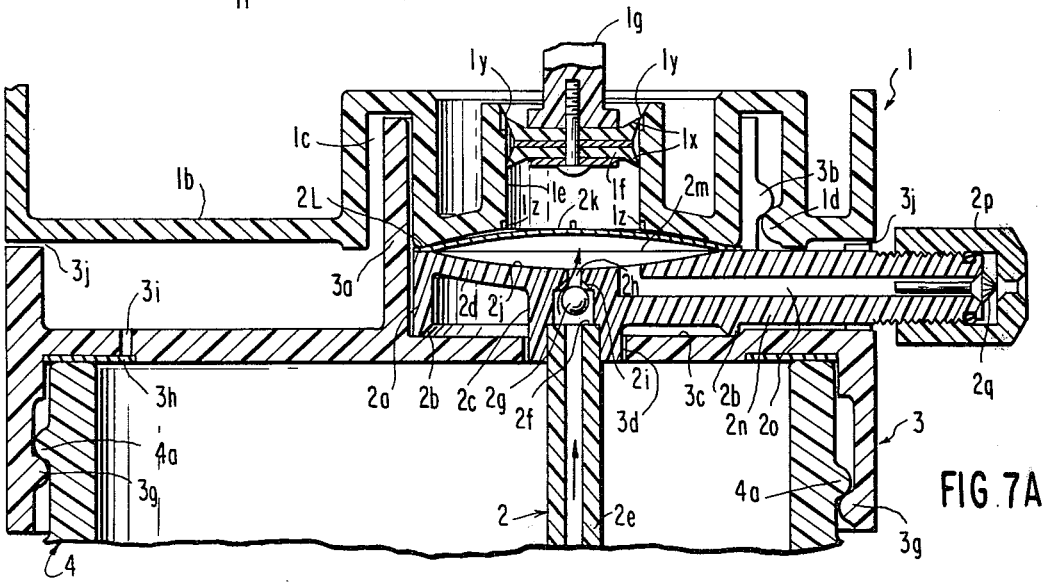
FIG. 7A
FIG. 7B
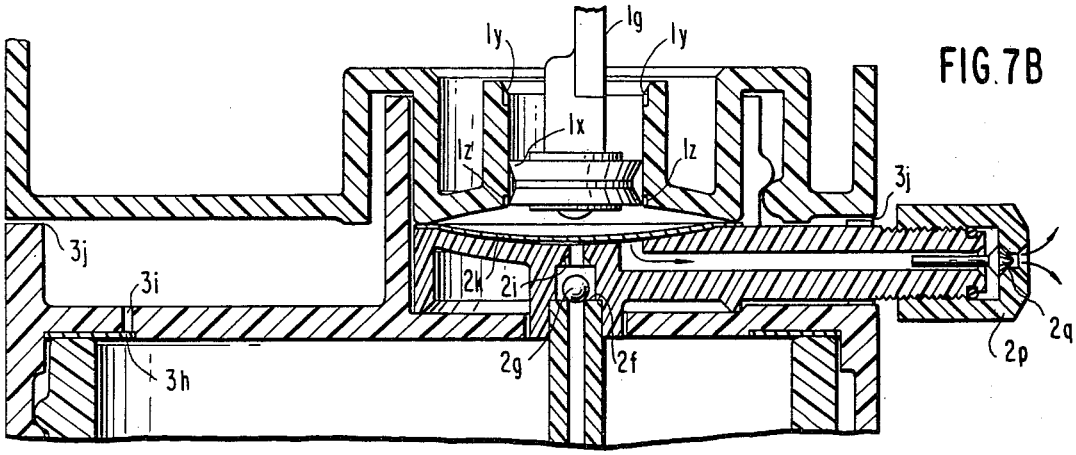

PISTON PUMP ACTUATED DIAPHRAGM PUMP FOR SPRAYING LIQUIDS

BACKGROUND OF THE INVENTION

Heretofore, aerosol-type dispensers have been employed for dispensing various types of liquids such as paint, air freshener, hair spray, and the like. However, the use of aerosol-type dispensers has become less popular of late due to the reported breakdown of the ozone layer in the atmosphere caused by the propellants used in the aerosols.

To overcome the hazardous condition caused by aerosol-type dispensers, the use of pumps as the discharge assistant is becoming more prevalent. The conventional dispensing pump includes a dip tube extending into the container of fluid to be dispensed and a plunger or piston assembly and outlet nozzle mounted on the container closure, whereby the reciprocation of the plunger causes a measured amount of fluid to be drawn through the dip tube and dispensed through the nozzle.

While the use of conventional pumps has been satisfactory for avoiding hazardous aerosols, they have not been universally accepted by the general public due in large measure by the pumps' lack of versatility for dispensing different types of fluids. More particularly, a pump provided for dispensing paint from one container cannot be employed for dispensing a different colored paint from another container without first spending a considerable amount of time cleaning the pump assembly.

After considerable research and experimentation, the dispenser of the present invention has been devised to overcome the disadvantages of conventional dispensing pumps, and comprises, essentially, a motor actuated piston pump assembly mounted in a housing which is detachably connected to a container closure having a diaphragm pump-spray nozzle assembly mounted thereon. The piston pump actuates the diaphragm pump-spray nozzle assembly for dispensing fluid from the container. The piston pump and diaphragm pump are constructed and arranged so that the piston pump does not become contaminated by the fluid being dispensed and, therefore, can be detachably connected to other containers having similarly mounted diaphragm pump-spray nozzle assemblies whereby various types of fluids, such as paint, air freshener, water, hair spray, and the like can be successively dispensed.

BRIEF DESCRIPTION OF THE DRAWINGS

FIG. 1 is an exploded view of the pump dispenser of the present invention;

FIG. 2 is a side elevational view, partially in section, showing the piston pump assembly;

FIG. 2*a* is a fragmentary, side elevational view, partially in section, showing the drive components for the piston pump;

FIG. 3 is a view taken along line 3—3 of FIG. 2;

FIG. 4 is a view taken along line 4—4 of FIG. 2*a;*

FIG. 5 is a view taken along line 5—5 of FIG. 2 showing the piston mid-way in its stroke;

FIG. 6 is a top plan view of the container closure; and

FIGS. 7*a* and 7*b* are fragmentary, side elevational views showing the suction and pumping strokes, respectively, of the piston and diaphragm pumps.

DESCRIPTION OF THE PREFERRED EMBODIMENT

Referring to the drawings, and more particularly to FIG. 1 thereof, the dispenser assembly of the present invention comprises a motor actuated piston pump assembly 1, and a diaphragm-spray nozzle assembly 2, the diaphragm-spray nozzle assembly being mounted within a closure or cap 3 of a container 4, the piston pump assembly 1 being detachably connected to the closure 3, to be described more fully hereinafter.

The details of the construction of the piston pump assembly 1 are shown in FIGS. 2, 2*a* and 5 wherein a housing 1*a* is provided, the housing wall being configured to facilitate being gripped by the operator. The bottom wall 1*b* of the housing is formed with an annular recess 1*c* for receiving the neck 3*a* of the closure 3, a threaded portion 1*d* being formed in the recess cooperating with a threaded portion 3*b* on the closure neck, whereby the housing 1*a* is detachably connected to the closure 3. The bottom wall 1*b* of the housing is also provided with a bore 1*e* forming a cylinder for a piston 1*f* having a piston rod lg. Reciprocatory movement is imparted to the piston rod 1*g* by an eccentric 1*h* rotatably mounted in an elliptical aperture 1*i* provided in the piston rod. The eccentric 1*h* forms the hub portion of a ring gear 1*j* having internal teeth 1*k* meshing with a drive pinion 1*L* driven by an electric motor 1*m*, the pinion extending through a slot 1*n* provided in the piston rod. The components are supported in the housing 1*a* by a vertically extending wall 1*o* having its lower edge inserted between a pair of spaced, upwardly extending lugs or ears 1*p* integral with the bottom wall of the housing, and the upper edge of the wall 1*o* being inserted between a pair of depending lugs 1*q* integral with the top wall of the housing. The eccentric 1*h* and associated ring gear 1*j* are rotatably mounted on a stub shaft 1*r* secured to and extending outwardly from the wall 1*o*. As will be seen in FIGS. 2*a* and 4, the upper portion of the piston rod 1*g* is guided during its reciprocatory movement by a bifurcated member 1*s* extending outwardly from the wall 1*o* for guiding the lateral edges and one face of the piston rod, the opposite face of the piston rod being guided by a pair of depending lugs 1*t* integral with the top wall of the housing. The motor 1*m* is energized by a plurality of batteries 1*u* mounted in the housing, the circuit between the batteries and motor being controlled by a switch 1*v* (FIG. 3) actuated by a button 1*w* mounted on the side wall of the housing 1*a*. While a battery energized d.c. motor has been shown and described, it will be appreciated by those skilled in the art that an a.c. motor could also be employed to be connected to the standard 110 V a.c. circuit.

Referring to FIGS. 1, 7*a* and 7*b*, the diaphragm-spray nozzle assembly 2 comprises a cylindrical housing 2*a* having its bottom edge 2*b* seated on the upper surface 3*c* of the cap 3 within the neck portion 3*a*. An aperture 3*d* is provided within the cap 3 for receiving a depending tubular boss 2*c* integrally connected to the top wall 2*d* of the cylindrical housing 2*a*. The upper end of a dip tube 2*e* is inserted within and integrally connected to the boss 2*c*, the upper edge 2*f* of the dip tube 2*e* providing a seat for a ball check valve 2*g* contained within the tubular boss 2*c*. An orifice 2*h* is formed through the top wall 2*d* of the cylindrical housing 2*a* and communicates with the interior of the boss 2*c*, a spider 2*i* being provided at the inner end of the orifice to prevent the check valve 2*g* from closing the orifice 2*h* during the suction stroke, to be described hereinafter. The top wall 2*d* of the cylindrical housing 2*a* is formed with a concave surface 2*j* and a thin, flexible membrane disc forming a diaphragm 2*k* is integrally connected along its peripheral edge to the top wall 2*d* of the cylindrical housing 2*a* as at 2*L*, to thereby provide a chamber 2*m* between the diaphragm 2*k* and the concave surface 2*j*.

To complete the structure of the spray-nozzle assembly, the cylindrical housing 2*a* has an integral, tubular stem 2*n* extending radially outwardly from the side wall thereof, the stem 2*n* having a bore 2*o* communicating with the chamber 2*m*. The outer end of the stem 2*n* has an orifice plate 2*p* threaded thereon which cooperates with a serrated outlet valve 2*q* slidably mounted in the end of the stem to thereby form a nozzle. The outer end of the bore 2*o* provides a seat for the outlet valve 2*q* during the suction stroke, as shown in FIG. 7*a*, and the serrated head portion 2*r* of the valve allows fluid to spray through the orifice plate 2*p* during the discharge stroke as shown in FIG. 2*b*. In order to accommodate the radially extending stem 2*n*, the outer wall of the cap 3 and the wall of the cap neck 3*a* are provided with cut-out portions 3*e* and 3*f*, respectively, as shown in FIG. 6.

As will be seen in FIGS. 7*a* and 7*b*, the closure or cap 3 is provided with internal threads 3*g* which cooperate with threads 4*a* on the top portion of the container 4, and a rubber ring seal 3*h* is mounted between the upper edge of the container 4 and the bottom surface of the cap, the seal 3*h* extending radially inwardly to cover a plurality of vent apertures 3*i* provided in the cap 3.

To assemble the components of the dispenser of the present invention, the seal 3*h* is placed on the top edge of the container 4 containing the fluid to be dispensed. The closure 3 is then threaded onto the container 4 and the diaphragm spray-nozzle assembly 2 is inserted into the neck portion 3*a* of the closure. The piston pump assembly 1 is then threaded onto the neck portion 3*a* of the closure, thereby hermetically sealing the diaphragm 2*k* along its peripheral edge 2*b* to the housing 2*a*.

In the operation of the dispenser, the operator presses the switch button 1*w* closing the electrical circuit to energize the motor 1*m* which in turn will cause the piston 1*f* to reciprocate via the drive pinion 1*L*, ring gear 1*j*, and eccentric 1*i*. During the upward movement of the piston 1*f*, the diaphragm 2*k* is drawn upwardly, as shown in FIG. 7*a*, creating a vacuum in chamber 2*m*, thereby causing fluid from the container 4 to flow upwardly in the direction of the arrows through the dip tube 2*e* into the chamber 2*m*, the spider 2*i* preventing the check valve 2*g* from closing the orifice 2*h*, while the outlet valve 2*q* is drawn inwardly to the closed position. During the downward movement of the piston 1*f*, as shown in FIG. 7*b*, air trapped within the cylinder 1*e* forces the diaphragm 2*k* downwardly causing the fluid to be discharged from the chamber 2*m* outwardly through the stem 2*n* and the spray nozzle. The increased pressure within the chamber 2*m* causes the check valve 2*g* to be moved to the closed position while the outlet valve 2*q* is moved to the open position.

When assembled, it will be noted that a slight clearance 3*j* is provided between the upper edge of the closure wall and the lower surface of the housing bottom wall 1*b*, whereby the top surface of the closure 3 will be at atmospheric pressure which will cause the seal 3*h* to move to the open position to open the vent holes 3*i* to thereby prevent a vacuum build-up in the container 4. It will also be noted that the piston 1*f* includes axially spaced, oppositely extending lip portions 1*x* which cooperate with the cylinder wall 1*e* and notches 1*y* and 1*z* formed in the cylinder wall at each end thereof to thereby control the build-up of pressure in the cylinder and the release thereof during the reciprocation of the piston 1*f*. In this connection, as the piston 1*f* moves to the end of its downward stroke (FIG. 7*b*), the lower lip 1*x* approaches the lower notch 1*z* allowing the trapped compressed air to escape past the lower and upper lips 1*x* to the atmosphere. On the upward stroke, the upper lip seals the piston against the cylinder wall creating a vacuum on the diaphragm 2*k* causing the fluid to flow into chamber 2*m*. As the piston 1*f* approaches the upper end of its stroke (FIG. 7*a*), the upper lip of the piston approaches notch 1*y* thereby venting the cylinder to the atmosphere whereby the vacuum imposed on the diaphragm is relieved therefrom.

After dispensing the required amount of fluid from the container 4, the diaphragm-pump spray nozzle assembly 2 can be cleared of fluid which might harden in time, such as paint, by merely turning the container 4 upside down and depressing the switch button 1*w* until clear air is dispensed through the orifice plate 2*p*. The diaphragm pump spray nozzle assembly 2 can remain assembled to the closure 3 and container 4 for future use, while the piston pump assembly 1 can be detached from the closure 3 and used on another container having a similarly mounted diaphragm pump-spray nozzle assembly.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. A piston pump actuated diaphragm pump for spraying liquids comprising, a container containing fluid to be dispensed, a closure mounted on said container, a neck portion provided on said closure, a diaphragm-pump spray nozzle assembly mounted within said closure neck portion and communicating with the fluid in the container to be dispensed, said diaphragm-pump spray nozzle assembly including a cylindrical housing having side and top walls, the upper surface of the top wall of said housing being concave, a diaphragm secured to the upper surface of the top wall to thereby form a chamber between the lower surface of the diaphragm and the concave surface of the housing top wall; and a motor actuated piston pump assembly detachably connected to said closure neck portion and separate from said diaphragm pump spray nozzle assembly, said piston pump assembly including a housing having a bottom wall, an annular recess formed in the bottom wall of said piston pump housing for receiving the neck portion of said closure, a bore provided in said bottom wall of said piston pump housing concentric with respect to said annular recess, a piston slidably mounted in said bore, the portion of the bottom wall of said piston pump housing within the neck portion of the closure being superimposed on said diaphragm, whereby upon actuation of the piston pump assembly the diaphragm-pump spray nozzle assembly dispenses fluid from the container while preventing the piston pump assembly from becoming contaminated by the fluid being dispensed; the motor actuated piston pump assembly being detachably connectable to other containers having similarly mounted diaphragm-pump spray nozzle assemblies, whereby various types of fluids, such as paint, air freshener, water, hair spray and the like can be successively dispensed.

2. A piston pump actuated diaphragm pump for spraying liquids according to claim 1, wherein an orifice is provided in the top wall of said diaphragm-pump housing communicating with said chamber, a dip tube connected to said diaphragm-pump housing, the lower end of said dip tube extending into the fluid container and the upper end of the tube connected to said diaphragm-pump housing in spaced relationship to said orifice, a check valve positioned in said diaphragm-pump housing within the space between the upper end of the dip tube and said orifice, a stem extending transversely from the side wall of said diaphragm-pump housing, the stem having a bore communicating with said chamber, and a spray valve assembly connected to the outer end of said stem communicating with said stem bore.

3. A piston pump actuated diaphragm pump for spraying liquids according to claim 1, wherein a piston rod is connected to said piston, motor means mounted in said housing, and transmission means connected between said motor means and said piston rod for causing reciprocation of said piston in said bore.

4. A piston pump actuated diaphragm pump for spraying liquids according to claim 3, wherein said motor means comprises an electric motor, a plurality of batteries mounted in said housing for energizing said motor, and switch means mounted on said housing for controlling the electrical circuit between said batteries and said motor.

5. A piston pump actuated diaphragm pump for spraying liquids according to claim 3, wherein the transmission means comprises a drive pinion connected to said motor means, a ring gear having internal teeth meshing with said drive pinion, a stub shaft mounted in said housing, said ring gear having a hub portion rotatably mounted on said stub shaft, said hub portion having an eccentric formed thereon, an elongated aperture provided in said piston rod for receiving said eccentric hub portion of said ring gear.

6. A piston pump actuated diaphragm pump for spraying liquids according to claim 3, wherein the piston includes axially spaced, oppositely extending lip portions engaging the side wall of said bore, and notches formed in the bore side wall at each end thereof to thereby control the build-up of pressure in the bore and the release thereof during the reciprocation of the piston.

7. A piston pump actuated diaphragm pump for spraying liquids according to claim 3, wherein the housing is configured to facilitate being gripped by the operator.

8. A piston pump actuated diaphragm pump for spraying liquids according to claim 1, wherein a plurality of vent apertures are provided in said closure, and a ring seal positioned between the upper edge of said container and said closure for closing said vent apertures.

* * * * *

UNITED STATES PATENT AND TRADEMARK OFFICE

CERTIFICATE OF CORRECTION

PATENT NO. : 4,364,520

DATED : Dec. 21, 1982

INVENTOR(S) : Edwin J. Weber, Sr.

It is certified that error appears in the above-identified patent and that said Letters Patent are hereby corrected as shown below:

On the title page:

Change the filing date from "August 26, 1970" to -August 26, 1980-.

Signed and Sealed this

*Fifteenth* Day of *March 1983*

[SEAL]

*Attest:*

GERALD J. MOSSINGHOFF

*Attesting Officer*

*Commissioner of Patents and Trademarks*